US011401771B2

(12) United States Patent
McGuire

(10) Patent No.: US 11,401,771 B2
(45) Date of Patent: Aug. 2, 2022

(54) ROTATING CONTROL DEVICE SYSTEMS AND METHODS

(71) Applicant: Cameron International Corporation, Houston, TX (US)

(72) Inventor: Stephen McGuire, Hockley, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 16/854,532

(22) Filed: Apr. 21, 2020

(65) Prior Publication Data

US 2021/0324700 A1 Oct. 21, 2021

(51) Int. Cl.
*E21B 33/08* (2006.01)
*E21B 47/09* (2012.01)

(52) U.S. Cl.
CPC ..... *E21B 33/085* (2013.01); *E21B 47/09* (2013.01)

(58) Field of Classification Search
CPC ..... E21B 33/085; E21B 47/09
See application file for complete search history.

(56) References Cited

U.S. PATENT DOCUMENTS

| | | | |
|---|---|---|---|
| 3,492,007 | A | 1/1970 | Jones |
| 6,352,129 | B1 | 3/2002 | Best |
| 6,575,244 | B2 | 6/2003 | Chang et al. |
| 6,904,981 | B2 | 6/2005 | van Riet |
| 7,004,448 | B2 | 2/2006 | Suter et al. |
| 7,165,610 | B2 | 1/2007 | Hopper |
| 7,185,719 | B2 | 3/2007 | van Riet |
| 7,274,989 | B2 * | 9/2007 | Hopper ..... E21B 41/00 702/6 |
| 7,350,597 | B2 | 4/2008 | Reitsma et al. |
| 7,478,672 | B2 | 1/2009 | Rogers et al. |
| 7,487,837 | B2 | 2/2009 | Bailey et al. |
| 7,828,081 | B2 | 11/2010 | Reitsma |
| 7,866,399 | B2 | 1/2011 | Kozicz et al. |
| 8,096,711 | B2 | 1/2012 | Beauchamp et al. |
| 8,286,734 | B2 | 10/2012 | Hannegan et al. |
| 8,413,724 | B2 | 4/2013 | Carbaugh et al. |

(Continued)

FOREIGN PATENT DOCUMENTS

| | | | |
|---|---|---|---|
| EP | 0261629 | A2 | 3/1988 |
| EP | 3231986 | A1 | 10/2017 |

(Continued)

OTHER PUBLICATIONS

International Search Report and Written Opinion issued in PCT Application PCT/US2021/026849, dated Jul. 23, 2021 (12 pages).

*Primary Examiner* — Taras P Bemko
(74) *Attorney, Agent, or Firm* — Kelly McKinney

(57) ABSTRACT

A rotating control device (RCD) system includes a first RCD comprising a first body and a first sealing element within the first body and a second RCD comprising a second body a second sealing element within the second body. The RCD system also includes a controller that is configured to control a first actuator assembly to adjust the first RCD to a withdrawn configuration in which the first sealing element is not positioned to seal about a tubular and to control a second actuator assembly to maintain the second RCD in a sealing configuration in which the second sealing element is positioned to seal about the tubular while the first RCD is in the withdrawn configuration.

19 Claims, 4 Drawing Sheets

(56) References Cited

U.S. PATENT DOCUMENTS

| | | | | |
|---|---|---|---|---|
| 8,567,525 | B2 | 10/2013 | Reitsma | |
| 8,573,294 | B2 | 11/2013 | Struthers et al. | |
| 8,596,345 | B2 | 12/2013 | Li et al. | |
| 8,631,874 | B2 | 1/2014 | Kozicz et al. | |
| 8,726,983 | B2 | 5/2014 | Khan | |
| 8,757,272 | B2 | 6/2014 | Couturier et al. | |
| 8,820,747 | B2 | 9/2014 | Zubia et al. | |
| 8,844,633 | B2 | 9/2014 | Reitsma et al. | |
| 9,038,729 | B2 | 5/2015 | Leduc et al. | |
| 9,109,405 | B2 | 8/2015 | Carbaugh et al. | |
| 9,109,420 | B2 | 8/2015 | Tindle et al. | |
| 9,151,135 | B2 | 10/2015 | Eriksen | |
| 9,228,433 | B2 | 1/2016 | Sawyer et al. | |
| 9,284,811 | B2 | 3/2016 | Michaud et al. | |
| 9,328,574 | B2 | 5/2016 | Sehsah | |
| 9,341,037 | B2 | 5/2016 | Suter | |
| 9,388,650 | B2 | 7/2016 | Leuchtenberg | |
| 9,429,007 | B2 | 8/2016 | Reitsma et al. | |
| 9,976,411 | B2 * | 5/2018 | Scott | E21B 47/09 |
| 10,570,689 | B2 * | 2/2020 | Jaffrey | E21B 33/0355 |
| 2010/0012317 | A1 | 1/2010 | Shelton | |
| 2011/0024195 | A1 * | 2/2011 | Hoyer | E21B 21/08 175/65 |
| 2012/0241163 | A1 | 9/2012 | Reitsma et al. | |
| 2014/0048331 | A1 | 2/2014 | Boutalbi et al. | |
| 2014/0209316 | A1 | 7/2014 | Tindle et al. | |
| 2014/0216751 | A1 | 8/2014 | Liezenberg | |
| 2014/0262313 | A1 | 9/2014 | Gilmore et al. | |
| 2015/0034384 | A1 | 2/2015 | Leuchtenberg | |
| 2015/0308253 | A1 * | 10/2015 | Clark | E21B 44/00 175/24 |
| 2016/0230491 | A1 | 8/2016 | Hannegan et al. | |
| 2017/0074067 | A1 * | 3/2017 | Jaffrey | E21B 34/16 |
| 2018/0245444 | A1 * | 8/2018 | Hardt | E21B 44/00 |
| 2018/0274323 | A1 * | 9/2018 | Arefi | E21B 47/08 |
| 2018/0306750 | A1 * | 10/2018 | Huang | G01N 29/4472 |

FOREIGN PATENT DOCUMENTS

| | | | |
|---|---|---|---|
| WO | 2007047800 | A2 | 4/2007 |
| WO | 2010082831 | A1 | 7/2010 |
| WO | 2012035001 | A2 | 3/2012 |
| WO | 2014087371 | A1 | 6/2014 |
| WO | 2017039434 | A1 | 3/2017 |

* cited by examiner

ROTATING CONTROL DEVICE SYSTEMS AND METHODS

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Oil and natural gas have a profound effect on modern economies and societies. In order to meet the demand for such natural resources, numerous companies invest significant amounts of time and money in searching for, accessing, and extracting oil, natural gas, and other subterranean resources. Particularly, once a desired resource is discovered below the surface of the earth, drilling systems are often employed to access the desired resource. These drilling systems can be located onshore or offshore depending on the location of the desired resource. Such drilling systems may include a drilling fluid system configured to circulate drilling fluid into and out of a wellbore to facilitate drilling the wellbore.

BRIEF DESCRIPTION OF THE DRAWINGS

Various features, aspects, and advantages of the present disclosure will become better understood when the following detailed description is read with reference to the accompanying figures in which like characters represent like parts throughout the figures, wherein.

DETAILED DESCRIPTION OF SPECIFIC EMBODIMENTS

Figure 1:
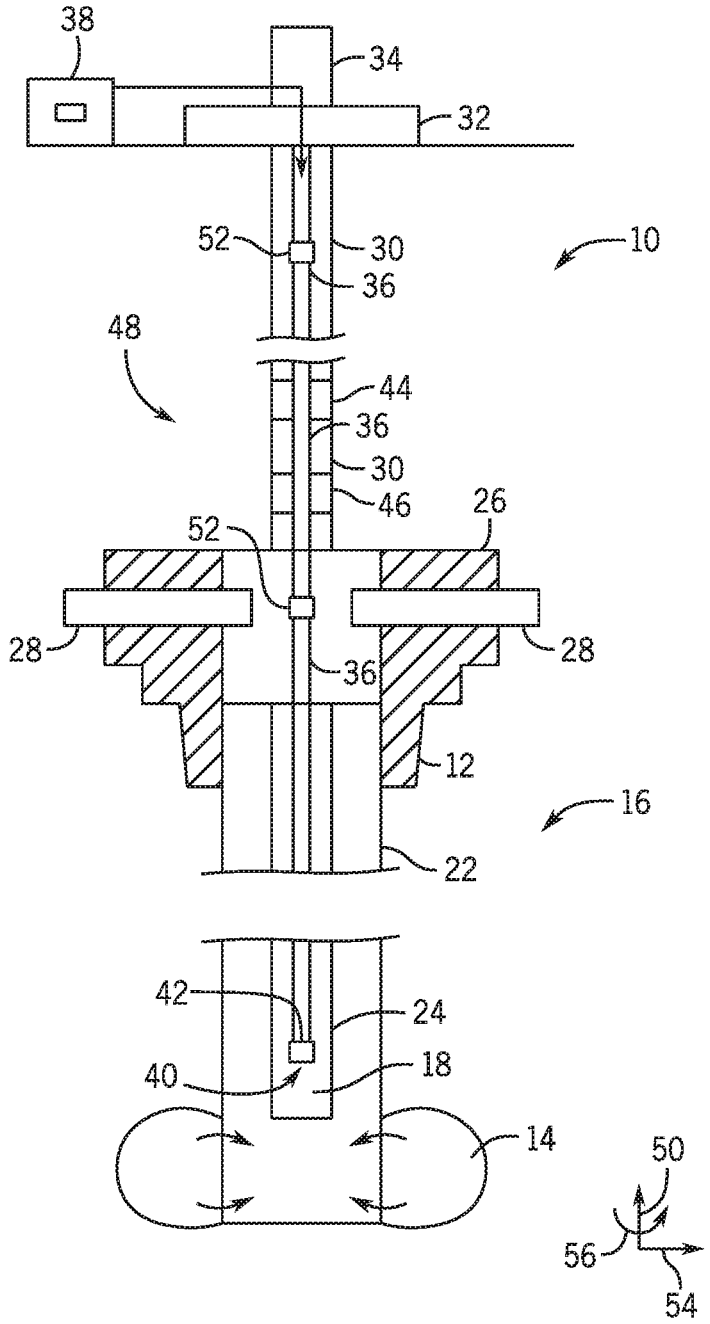
FIG. 1 is a schematic diagram of a drilling system that includes a rotating control device (RCD) system, in accordance with an embodiment of the present disclosure.

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," "said," and the like, are intended to mean that there are one or more of the elements. The terms "comprising," "including," "having," and the like are intended to be inclusive and mean that there may be additional elements other than the listed elements. The use of "top," "bottom," "above," "below," and variations of these terms is made for convenience, but does not require any particular orientation of the components relative to some fixed reference, such as the direction of gravity. The term "fluid" encompasses liquids, gases, vapors, and combinations thereof.

As set forth above, a drilling system may include a drilling fluid system that is configured to circulate drilling fluid into and out of a wellbore to facilitate drilling the wellbore. For example, the drilling fluid system may provide a flow of the drilling fluid through a drill string as the drill string rotates a drill bit that is positioned at a distal end portion of the drill string. The drilling fluid may exit through one or more openings at the distal end portion of the drill string and may return toward a platform of the drilling system via an annular space between the drill string and a casing that lines the wellbore.

In some cases, the drilling system may use managed pressure drilling ("MPD"). MPD regulates a pressure and a flow of the drilling fluid within the drill string so that the flow of the drilling fluid does not over pressurize a well (e.g., expand the well) and/or blocks the well from collapsing under its own weight. The ability to manage the pressure and the flow of the drilling fluid enables use of the drilling system to drill in various locations, such as locations with relatively softer sea beds.

The drilling system of the present disclosure may include a rotating control device (RCD) system that includes multiple RCDs spaced apart from one another. Each RCD of the multiple RCDs is configured to form a seal across and/or to block fluid flow through the annular space that surrounds the drill string. For example, the RCD may be configured to block the drilling fluid, cuttings, and/or natural resources (e.g., carbon dioxide, hydrogen sulfide) from passing across the RCD from the well toward the platform. In some embodiments, the fluid flow may be diverted toward another suitable location (e.g., a collection tank) other than the platform.

During drilling operations, a sealing element of the RCD may seal against the drill string as the drill string rotates and moves axially within the wellbore. The sealing element of the RCD may rotate with the drill string as the drill string rotates and moves axially within the wellbore (e.g., the sealing element of the RCD may be driven to rotate by the drill string). The drill string may include multiple pipe segments that are arranged end-to-end, as well as joints (e.g., tool joints) that join adjacent pipe segments to one another to form the drill string. A respective diameter (e.g., pipe diameter) of each pipe segment may be less than a respective diameter (e.g., joint diameter) of each joint.

Without the disclosed embodiments, as the drill string moves axially within the wellbore, each joint may push the sealing element of the RCD radially outwardly as the joint moves axially across the sealing element of the RCD (e.g., as compared to when each pipe segment is within the sealing element). However, in the present embodiments, the multiple RCDs include a first RCD positioned at a first location along an axial axis of the wellbore, and a second RCD positioned at a second location along the axial axis of the wellbore. In operation, the first RCD and the second RCD may be controlled in a coordinated manner to facilitate passage of the joints of the drill string, and to thereby reduce wear on the sealing elements of the RCDs. For example, as the drill string rotates and moves axially within the wellbore, one of the first RCD or the second RCD may be in a sealing configuration (e.g., extended configuration) while another one of the first RCD or the second RCD may be in a withdrawn configuration (e.g., retracted configuration).

In particular, as the joint approaches the first RCD, the first RCD may be controlled to move to the withdrawn configuration in which the respective sealing element of the first RCD is no longer driven radially inwardly and/or is pulled radially-outwardly to facilitate passage of the joint across the first RCD. While the first RCD is in the withdrawn configuration, the second RCD may be in the sealing configuration to seal against the drill string and to block fluid flow through the annular space that surrounds the drill string. Then, as the joint approaches the second RCD, the second RCD may be controlled to move to the withdrawn configuration in which the respective sealing element of the second RCD is no longer driven radially inwardly and/or is pulled radially-outwardly to facilitate passage of the joint across the second RCD. While the second RCD is in the withdrawn configuration, the first RCD may be in the sealing configuration to seal against the drill string and to block fluid flow through the annular space that surrounds the drill string. As discussed in more detail below, the RCD system may include a controller (e.g., electronic controller) that controls the first RCD and the second RCD in this coordinated manner.

FIG. 1 is a schematic diagram that illustrates an embodiment of a drilling system 10 that is configured to carry out drilling operations. The drilling system 10 may be a subsea system, although the disclosed embodiments may be used in a land-based (e.g., surface) system. The drilling system 10 may use MPD techniques. As illustrated, the system 10 includes a wellhead assembly 12 coupled to a mineral deposit 14 via a well 16 having a wellbore 18.

The wellhead assembly 12 may include or be coupled to multiple components that control and regulate activities and conditions associated with the well 16. For example, the wellhead assembly 12 generally includes or is coupled to pipes, bodies, valves, and seals that enable drilling of the well 16, route produced minerals from the mineral deposit 14, provide for regulating pressure in the well 16, and provide for the injection of drilling fluids into the wellbore 18. A conductor 22 may provide structure for the wellbore 18 and may block collapse of the sides of the well 16 into the wellbore 18. A casing 24 may be disposed within the conductor 22. The casing 24 may provide structure for the wellbore 18 and may facilitate control of fluid and pressure during drilling of the well 16. The wellhead 12 may include a tubing spool, a casing spool, and a hanger (e.g., a tubing hanger or a casing hanger) to enable installation of the casing 24. As shown, the wellhead assembly 12 may include or be coupled to a blowout preventer (BOP) assembly 26, which may include one or more BOPs (e.g., one or more ram BOPs, one or more annular BOPs, or a combination thereof). For example, the BOP assembly 26 shown in FIG. 1 includes a ram BOP having moveable rams 28 configured to seal the wellbore 18.

A drilling riser 30 may extend between the BOP assembly 26 and a platform 32. The platform 32 may include various components that facilitate operation of the drilling system 10, such as pumps, tanks, and power equipment. The platform 32 may also include a derrick 34 that supports a tubular 36 (e.g., drill string), which may extend through the drilling riser 30. A drilling fluid system 38 may direct the drilling fluid into the tubular 36, and the drilling fluid may exit through one or more openings at a distal end portion 40 of the tubular 36 and may return (along with cuttings and/or other substances from the well 16) toward the platform 32 via an annular space (e.g., between the tubular 36 and the casing 24 that lines the wellbore 18; between the tubular 36 and the drilling riser 30). A drill bit 42 may be positioned at the distal end portion 40 of the tubular 36. The tubular 36 may rotate within the drilling riser 30 to rotate the drill bit 42, thereby enabling the drill bit 42 to drill and form the well 16.

As shown, the drilling system 10 may include multiple rotating control devices (RCD), such as a first RCD 44 and a second RCD 46, that are each configured to form a seal across and/or to block fluid flow through the annular space that surrounds the tubular 36. For example, the first RCD 44 and the second RCD 46 may each be configured to block the drilling fluid, cuttings, and/or other substances from the well 16 from passing across the first RCD 44 and the second RCD 46, respectively, from the well 16 toward the platform 32. The multiple RCDS may be part of an RCD system 48. It should be appreciated that the multiple RCDs may include any suitable number of RCDs (e.g., 2, 3, 4, or 5), and also that certain features (e.g., control features, features of a sealing element of the RCD, and/or features of an actuator system of the RCD) disclosed herein may be used in the context of a drilling system that includes only one RCD. Furthermore, the one or more RCDs may be positioned at any suitable location within the drilling system 10, such as any suitable location between the wellbore 18 and the platform 32. For example, as shown, the one or more RCDs may be positioned along the drilling riser 30 and between the BOP assembly 26 and the platform 32.

In operation, the tubular 36 may be rotated and/or moved along an axial axis 50 to enable the drill bit 42 to drill the well 16. The tubular 36 may be extended by coupling pipe segments to one another, and the tubular 36 may be retracted by uncoupling the pipe segments from one another. The pipe segments may be coupled to one another via joints 52 (e.g., tool joints), and a respective diameter (e.g., pipe diameter) of each pipe segment may be less than a respective diameter (e.g., joint diameter) of each joint. As discussed in more detail below, the first RCD 44 and the second RCD 46 may be controlled in a coordinated manner to facilitate passage of the joints 52 through the first RCD 44 and the second RCD 46, while also maintaining a seal against the tubular 36 using at least one of the first RCD 44 or the second RCD 46. The drilling system 10 and its components may be described with reference to the axial axis 50 (or axial direction), a radial axis 54 (or radial direction), and a circumferential axis 56 (or direction) to facilitate discussion.

Figure 2:
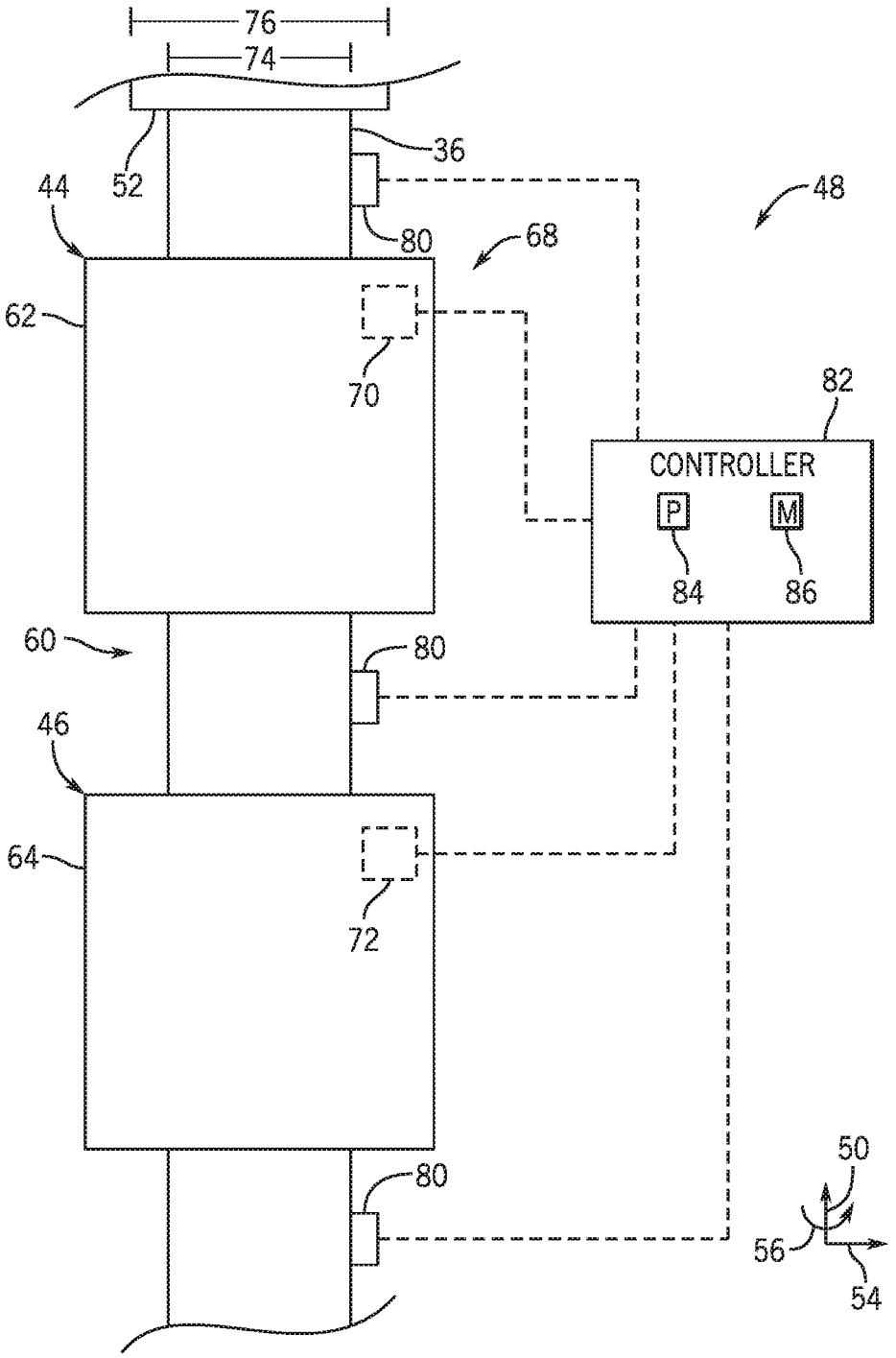
FIG. 2 is a schematic diagram of the RCD system of FIG. 1, wherein the RCD system includes multiple RCDs, in accordance with an embodiment of the present disclosure.

FIG. 2 is a schematic diagram of an embodiment of the RCD system 48. The RCD system 48 may include multiple RCDs, such as the first RCD 44 and the second RCD 46. As shown, the first RCD 44 and the second RCD 46 are spaced apart from one another along the axial axis 50. Thus, the first RCD 44 is positioned at a first portion of the tubular 36 and the second RCD 46 is positioned at a second portion of the tubular 36 at any given time. In some embodiments, a third portion of the tubular 36 may be positioned in an axial gap 60 between the first RCD 44 and the second RCD 46. The axial gap 60 may have any suitable length along the axial axis 50, such equal to or greater than 1, 2, 3, 4, 5, 10, 15, 20, 25, 50, 100, or more meters. It should be appreciated that the multiple RCD's may be positioned adjacent to one another (e.g., a first body 62 of the first RCD 44 may be fastened, such as via one or more bolts, to a second body 64 of the second RCD 46). In such cases, respective sealing elements of the first RCD 44 and the second RCD 46 may still be separated from one another along the axial axis 50 (e.g., by any suitable distance) to facilitate the disclosed techniques.

In particular, each of the first RCD 44 and the second RCD 46 may include a respective sealing element (e.g., annular and/or elastomer sealing element) that is configured to seal against the tubular 36. For example, the first RCD 44 may include a first sealing element that is configured to move between a sealing configuration in which the first sealing element contacts and seals against the tubular 36 and a withdrawn configuration in which the first sealing element does not contact and/or does not seal against the tubular 36. An inner diameter of the first sealing element of the first RCD 44 may therefore be smaller when the first RCD 44 is in the sealing configuration as compared to when the first RCD 44 is in the withdrawn configuration. The second RCD 46 may include a second sealing element that moves between the sealing configuration and the withdrawn configuration in the same manner.

The first sealing element and the second sealing element may be driven by an actuator system 68. For example, a first actuator assembly 70 (e.g., hydraulic actuator assembly) may be supported within or otherwise coupled to the first body 62. The first actuator assembly 70 may be controlled such that the first actuator assembly 70 exerts a first force in a radially-inward direction on the first sealing element to adjust the first sealing element from the withdrawn configuration to the sealing configuration and/or exerts a second force in a radially-outward direction on the first sealing element to adjust the first sealing element from the sealing configuration to the withdrawn configuration. A second actuator assembly 72 (e.g., hydraulic actuator assembly) may be supported within or otherwise coupled to the second body 64. The second actuator assembly 72 may be controlled such that the second actuator assembly 72 exerts a first force in a radially-inward direction on the second sealing element to adjust the second sealing element from the withdrawn configuration to the sealing configuration and/or exerts a second force in a radially-outward direction on the second sealing element to adjust the second sealing element from the sealing configuration to the withdrawn configuration.

In operation, the tubular 36 may rotate and move along the axial axis 50 during extension into the well and/or retraction from the well. The first sealing element of the first RCD 44 and the second sealing element of the second RCD 46 may be configured to seal against and to rotate with the tubular 36 as the tubular 36 rotates (e.g., the first sealing element and/or the second sealing element may be driven to rotate by the tubular 36) and while in the sealing configuration. As shown, the tubular 36 is formed by pipe segments that are joined to one another via joints, such as the illustrated joint 52. A respective diameter 74 (e.g., pipe diameter) of each pipe segment may be less than a respective diameter 76 (e.g., joint diameter) of the joint 52.

To block wear of the first sealing element and the second sealing element, the first RCD 44 and the second RCD 46 may be controlled to be in the withdrawn configuration as the joint 52 passes through the first RCD 44 and the second RCD 46. More particularly, the first RCD 44 and the second RCD 46 may be controlled in a coordinated manner, such that the first RCD 44 is in the withdrawn configuration as the joint 52 passes through the first RCD 44, and the second RCD 46 is in the withdrawn configuration as the joint 52 passes through the second RCD 46. Additionally, the second RCD 46 may be controlled to be in the sealed configuration to seal against the tubular 36 while the first RCD 44 is in the withdrawn configuration, and the first RCD 44 may be controlled to be in the sealed configuration to seal against the tubular 36 while the second RCD 46 is in the withdrawn configuration. As discussed in more detail below, the first RCD 44 and the second RCD 46 may be adjusted to the withdrawn configuration via control of the first actuator assembly 70 and the second actuator assembly 72, respectively, and such that the respective sealing element is no longer driven radially inwardly and/or is pulled radially-outwardly to facilitate passage of the joint 52.

To facilitate these techniques the RCD system 48 may include one or more sensors 80 and/or a controller 82 (e.g., electronic controller) having a processor 84 and a memory device 86. For example, the one or more sensors 80 may be configured to detect a presence of the joint 52. The one or more sensors 80 may send one or more signals indicative of a location of the joint 52 (e.g., relative to the first RCD 44 and/or the second RCD 46) to the controller 82. The processor 84 of the controller 82 may process the one or more signals and may determine an appropriate time to adjust the first RCD 44 and/or the second RCD 46 to the withdrawn configuration to enable passage of the joint 52. The processor 84 of the controller may also determine an appropriate time to adjust the first RCD 44 and/or the second RCD 46 to the sealing configuration so that at least one of the multiple RCDs seals against the tubular 36 at any given time.

For example, in the illustrated embodiment, one of the sensors 80 that is vertically above the first RCD 44 relative to the well may detect the presence of the joint 52 and may send signals to the controller 82. The controller 82 may process the signals and determine the appropriate time to adjust the first RCD 44 to the withdrawn configuration (e.g., so as to coincide with the passage of the joint 52 through the first RCD 44). The controller 82 may also adjust the second RCD 46 to the sealing configuration (e.g., so as to be in the sealing configuration while the first RCD 44 is in the withdrawn configuration). Then, as the joint 52 continues to move along the axial axis 50, at least one of the one or more sensors 80 positioned within the gap 60 between the first RCD 44 and the second RCD 46 may detect the presence of the joint 52 within the gap 60 and may send signals to the controller 82. The controller 82 may process the signals and determine the appropriate time to adjust the second RCD 46 to the withdrawn configuration (e.g., so as to coincide with the passage of the joint 52 through the second RCD 46). The controller 82 may also adjust the first RCD 44 to the sealing configuration (e.g., so as to be in the sealing configuration while the second RCD 46 is in the withdrawn configuration).

In some embodiments, the appropriate time may be as soon as or in response to receipt of the signals from the one or more sensors 80 that indicate the presence of the joint 52. For example, while the tubular 36 is moving in the axial direction 50 toward the well, the controller 82 may control the first RCD 44 to be in the withdrawn configuration as soon as or in response to receipt of the signals from the one of the sensors 80 that is vertically above the first RCD 44 relative to the well. As noted above, the first RCD 44 and the second RCD 46 may be arranged differently (e.g., without the gap 60), but generally the controller 82 may receive and process the signals from the sensors 80 positioned above and/or below the first RCD 44 and/or the second RCD 46 to determine the appropriate times to the adjust the first RCD 44 and/or the second RCD 46. Similar steps may be carried out as the tubular 36 is retracted from the well and the joint 52 passes in a reverse direction through the second RCD 46 and then through the first RCD 44.

The controller 82 may be configured to carry out other steps as part of the present techniques. For example, the controller 82 may maintain both the first RCD 44 and the second RCD 46 in the sealing configuration as a default configuration, and the controller 82 may then adjust one of the first RCD 44 or the second RCD 46 to the withdrawn configuration in response to receipt of the signals that indicate that the joint 52 is approaching the one of the first RCD 44 or the second RCD 46. However, in other embodiments, the controller 82 may maintain only one of the first RCD 44 or the second RCD 46 in the sealing configuration as a default configuration, and the controller 82 may then adjust one of the first RCD 44 or the second RCD 46 to the withdrawn configuration in response to receipt of the signals that indicate that the joint 52 is approaching the one of the first RCD 44 or the second RCD 46.

In such embodiments, as well as in any various other embodiments, the controller 82 may first adjust the other one of the first RCD 44 or the second RCD 46 to the sealing configuration and/or confirm that the other one of the first RCD 44 or the second RCD 46 is in the sealing configuration prior to adjusting the one of the first RCD 44 or the second RCD 46 to the withdrawn configuration. For example, the controller 82 may receive feedback signals from the first actuator assembly 70 and the second actuator assembly 72 that indicate that the first actuator assembly 70 or the second actuator assembly 72, respectively, is actuated (e.g., a piston is in an actuated position) to drive the first sealing element or the second sealing element against the tubular 36 to thereby reach and maintain the sealing configuration. As a more particular example, upon receipt of signals at the controller 82 that indicate that the first RCD 44 should be in the withdrawn configuration to facilitate passage of the joint 52 across the first RCD 44, the controller 82 may first adjust the second RCD 46 to the sealing configuration and/or confirm that the second RCD 46 is in the sealing configuration prior to adjusting the first RCD 44 to the withdrawn configuration.

In this way, the controller 82 may effectively control the components of the RCD system 48 such that at least one of the multiple RCDs is in the sealing configuration and seals against the tubular 36 throughout the drilling process. It should be appreciated that the controller 82 may additionally or alternatively be configured to adjust the first RCD 44 and the second RCD 46 based on other parameters (e.g., known parameters, such as a rate of travel of the tubular 36 in the axial direction 50, a distance or spacing between joints 52, a location of one joint 52, a location of the multiple RCDs, and/or a location of the one or more sensors 80 relative to the multiple RCDs) and/or based on inputs from an operator (e.g., the operator may instruct the controller 82 to open one or both of the multiple RCDs, such as for maintenance operations).

As shown, the controller 82 includes the processor 84 and the memory device 86. It should be appreciated that the controller 82 may be a dedicated controller for the RCD system 48 and/or the controller 82 may be part of or include a distributed controller with one or more electronic controllers in communication with one another to carry out the various techniques disclosed herein. The processor 84 may also include one or more processors configured to execute software, such as software for processing signals and/or controlling the components of the RCD system 48. The memory device 86 disclosed herein may include one or more memory devices (e.g., a volatile memory, such as random access memory [RAM], and/or a nonvolatile memory, such as read-only memory [ROM]) that may store a variety of information and may be used for various purposes. For example, the memory device 86 may store processor-executable instructions (e.g., firmware or software) for the processor 84 to execute, such as instructions for processing signals and/or controlling the components of the RCD system 48. It should be appreciated that the controller 82 may include various other components, such as a communication device that is capable of communicating data or other information (e.g., a current configuration of each of the multiple RCDs) to various other devices (e.g., a remote computing system or display system at the platform).

It should be appreciated that the one or more sensors 80 may include any suitable type of sensors capable of detecting the presence of the joint 52. For example, the one or more sensors 80 may include one or more acoustic sensors, and variations in the acoustic waves reflected off of the pipe segments and the joint 52 may indicate the presence of the joint 52. The one or more sensors 80 may include one or more contact sensors (e.g., detect the presence of the joint 52 via contact), optical sensors (e.g., detect the presence of the joint 52 via variations in the light reflected off of the pipe segments and the joint 52; via image-recognition technologies or image template matching techniques), or the like.

Figure 3:
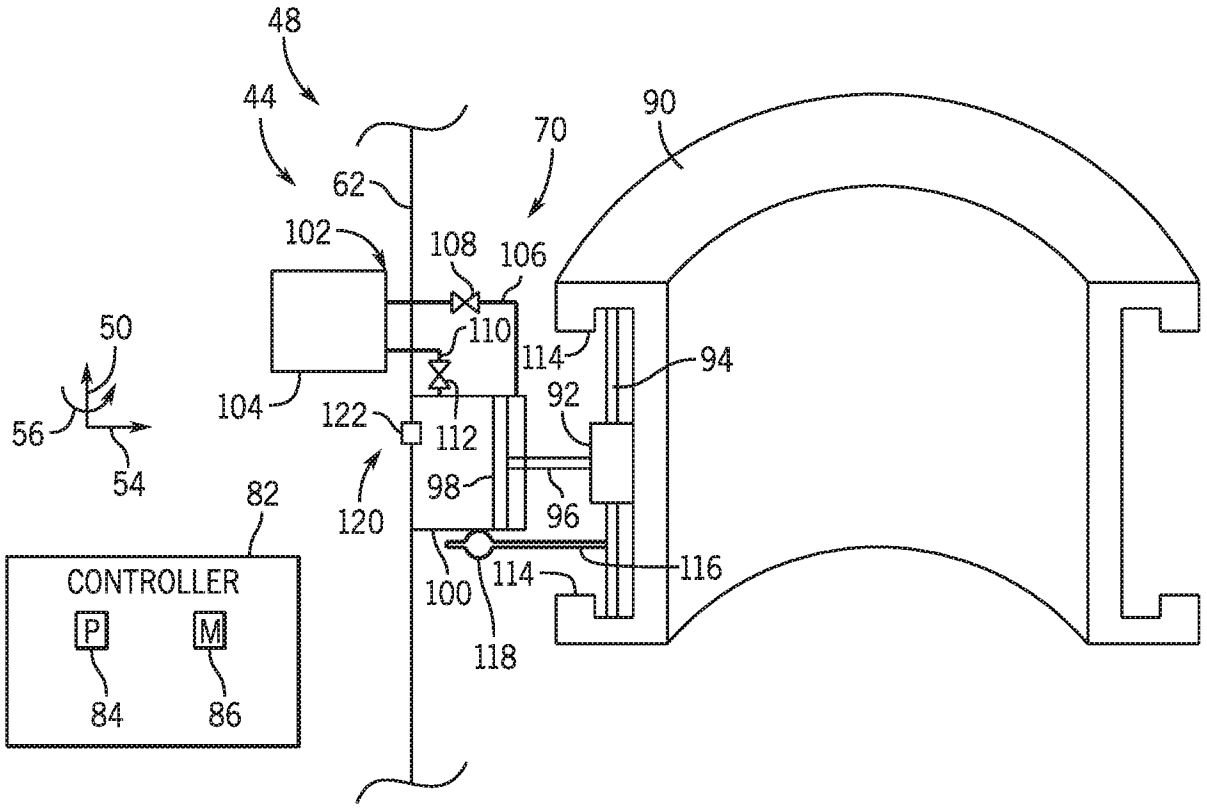
FIG. 3 is a cross-sectional side view of one of the multiple RCDs of FIG. 2, in accordance with an embodiment of the present disclosure.

FIG. 3 is a cross-sectional side view of an embodiment of one RCD, such as the first RCD 44, that may be used in the RCD system 48. As noted above, the first actuator assembly 70 may be configured to adjust a first sealing element 90 (e.g., annular sealing element) so that the first sealing element 90 is no longer driven radially-inwardly toward the tubular and/or so that the first sealing element 90 is pulled radially-outwardly away from the tubular to facilitate passage of the joint. The first actuator assembly 70 and the first sealing element 90 may have various features to facilitate these techniques. It should be appreciated that the second actuator assembly and the second sealing element of the second RCD may have the same or similar features.

As shown, the first actuator assembly 70 includes a push portion 92 (e.g., roller; bearing), a support rod 94 (e.g., axially-extending support rod), a connecting rod 96 (e.g., radially-extending connecting rod), a piston 98 within a cylinder 100, and a hydraulic fluid system 102. The hydraulic fluid system 102 may include a fluid source 104, a first flow path 106 to a first portion of the cylinder 100, a first valve 108 along the first flow path to adjust a flow of fluid from the fluid source 104 to the first portion of the cylinder, a second flow path 110 to a second portion of the cylinder 100, and a second valve 112 along the second flow path 110 to adjust a flow of fluid from the fluid source 104 to the second portion of the cylinder 100.

In operation, at the appropriate time as determined by the controller 82, the controller 82 may provide a control signal to control the first valve 108 to enable the flow of the fluid into the first portion of the cylinder 100. The piston 98 and the connecting rod 96 coupled thereto may be driven radially-outwardly by the fluid within the cylinder 100. Because the connecting rod 96 is coupled to the push portion 92, the connecting rod 96 may drive (e.g., pull) the push portion 92 radially-outwardly. Furthermore, because the push-portion 92 is coupled to the support rod 94, the connecting rod 96 may also drive the support rod 94 radially-outwardly. As the support rod 94 moves radially-outwardly, opposite ends of the support rod 94 may contact, engage, and exert a radially-outwardly force on lips 114 (e.g., annular lips; extensions), and thus, the connecting rod 96 may also drive the sealing element 90 radially-outwardly. In this way, the first actuator assembly 70 may adjust the sealing element 90 to the withdrawn configuration (e.g., from the sealing configuration to the withdrawn configuration). Advantageously, in the illustrated embodiment, the first actuator assembly 70 is configured to exert a radially-outward force on the sealing element 90 to pull the sealing element 90 out of a bore of the first RCD 44 (e.g., that extends through the sealing element 90) to facilitate passage of the joint (e.g., without contact between and/or blocking contact between the sealing element 90 and the joint).

Additionally, at the appropriate time as determined by the controller 82, the controller 82 may provide a control signal to control the second valve 112 to enable the flow of the fluid into the second portion of the cylinder 100. The piston 98 and the connecting rod 96 coupled thereto may be driven radially-inwardly by the fluid within the cylinder 100. Because the connecting rod 96 is coupled to the push portion 92, the connecting rod 96 may drive (e.g., push) the push portion 92 radially-inwardly into contact with the sealing element 90. In turn, the push portion 92 may exert a force on the sealing element to drive the sealing element 90 radially-inwardly to seal against the tubular. In this way, the first actuator assembly 70 may adjust the sealing element 90 to the sealing configuration (e.g., from the withdrawn configuration to the sealing configuration). The push portion 92 may be configured to rotate (e.g., about the support rod 94) to enable and support the rotation of the sealing element 90 with the tubular.

It should be appreciated that only a portion of the first actuator assembly 70 is shown in FIG. 3 to facilitate discussion. As explained herein, the first actuator assembly 70 is configured to exert the radially-inward force (and, in some embodiments, the radially-outward force) on the sealing element 90 about a circumference of the sealing element 90. Thus, the first actuator assembly 70 may include multiple push portions 92, multiple support rods 92, multiple connecting rods 96, multiple pistons 98, and multiple cylinders 100 that are distributed circumferentially about the sealing element 92. For example, the first actuator assembly 70 may include four sets of these components that each exert the force(s) on a quarter of the circumference of the sealing element 90 and together exert the force(s) on an entirety of the circumference of the sealing element 90. In such cases, multiple support rods 94 may be coupled to one another, such as in a curved grid pattern, and multiple push portions 92 may be coupled to the multiple support rods 94 so as to contact the sealing element 90 about the quarter of the circumference of the sealing element 90. It should be appreciated that any number of sets of these components may be provided (e.g., 1, 2, 3, 4, 5, 6, 7, 8, or more).

It may be desirable to provide additional support and/or linkages to the support rod 94. For example, one or more sliding support rods 116 (e.g., radially-extending support rods) may extend and slide through respective openings in one or more brackets 118 that are coupled (e.g., fastened) to the cylinder 100 or to another structure that is fixed relative to the first body 62 of the first RCD 44. One end of each of the one or more sliding support rods 116 may contact and support the support rod 94 (e.g., at a location+

It may be desirable to include a feedback system 120 that provides an indication of whether the sealing element 90 is in the withdrawn configuration or the sealing configuration. The feedback system 120 may include one or more sensors 122 of the first actuator assembly 70, and the one or more sensors 122 may provide signals indicative of the position of the sealing element 90 (e.g., via monitoring the position of the piston 98 within the cylinder 100, or via monitoring the position of some other component of the first actuator assembly 70, such as the push portion 92). It should be appreciated that any of a variety of other position-sensing sensor type(s) may be utilized, such as an internal linear displacement transducer (LDT), an external LDT, an optical sensor, and/or acoustic sensor. Regardless of the sensor type(s), the one or more sensors may output the signals to the controller 82 so that the controller 82 may process the signals to determine the position of the sealing element 90. Then, the controller 82 may utilize the position of the sealing element 90 to carry out other steps, as discussed above.

While the first RCD 44 in FIG. 3 includes an active-withdrawal system that actively exerts a radially-outward force on the sealing element 90 to drive the sealing element 90 to the withdrawn configuration, it should be appreciated that the disclosed techniques may be used with one or more RCDs that have other types of actuator assemblies. For example, the one or more RCDs may in a passive-withdrawal system that merely remove a radially-inward force on the sealing element such that the sealing element is no longer driven radially inwardly to relax and/or break the seal against the tubular and/or to increase the inner diameter of the sealing element to facilitate passage of the joint through the sealing element. It should be appreciated that the second RCD and/or any other RCDs within the RCD system 48 may include the configuration shown in FIG. 3 or any other suitable configuration.

Figure 4:
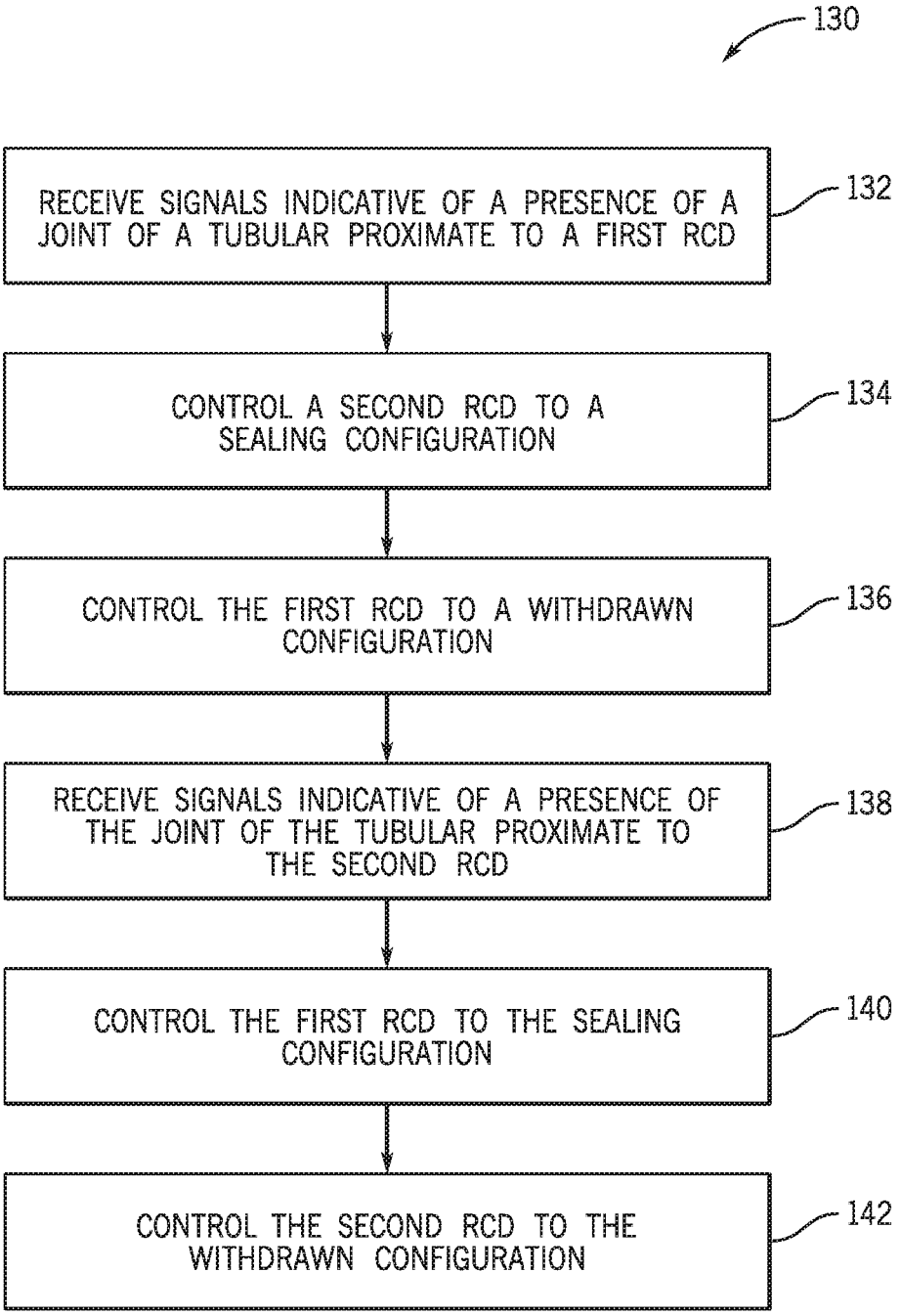
FIG. 4 is a flow diagram of a method of operating the RCD system of FIG. 1, in accordance with an aspect of the present disclosure.

FIG. 4 is a flow diagram of a method 130 of operating the RCD system of FIG. 1, in accordance with an aspect of the present disclosure. The method 130 includes various steps represented by blocks. It should be noted that some or all of the steps of the method 130 may be performed as an automated procedure by a controller, such as the controller 82. Although the flow chart illustrates the steps in a certain sequence, it should be understood that the steps may be performed in any suitable order and certain steps may be carried out simultaneously, where appropriate. Further, certain steps or portions of the method 130 may be omitted and other steps may be added.

As shown, in step 132, the controller 82 may receive signals indicative of a presence of the joint 52 of the tubular 36 proximate to the first RCD 44 (e.g., proximate to an entrance of the first RCD 44). As discussed above, the RCD system 48 may include one or more sensors 80 that are configured to detect the presence of the joint 52 and to provide the signals to the controller 82. The one or more sensors 80 may be positioned at or near ends of each of the multiple RCDs. For example, one sensor 80 may be positioned on a first side of the first RCD 44 (e.g., which forms the entrance to the first RCD 44 while the tubular 36 moves in a first direction along the axial axis 50 and forms an exit to the first RCD 44 while the tubular 36 moves in a second direction along the axial axis 50) and/or one sensor 80 may be positioned on a second side of the first RCD 44 (e.g., which forms the entrance to the first RCD 44 while the tubular 36 moves in the second direction along the axial axis 50 and forms the exit to the first RCD 44 while the tubular 36 moves in the first direction along the axial axis 50).

In step 134, the controller 82 may provide control signals to the second actuator assembly 72 associated with the second RCD 46 to drive the second RCD 46 to the sealing configuration in response to receipt of the signals indicative of the presence of the joint 52 of the tubular 36 proximate to the first RCD 44. As discussed above, in some cases, the second RCD 46 may already be in the sealing configuration (e.g., as a default). In some embodiments, the controller 82 may confirm that the second RCD 46 is in the sealing configuration prior to proceeding to step 136 (e.g., based on signals from the one or more sensors 122).

In step 136, the controller 82 may provide control signals to the first actuator assembly 70 associated with the first RCD 44 to drive the first RCD 44 to the withdrawn configuration in response to receipt of the signals indicative of the presence of the joint 52 of the tubular 36 proximate to the first RCD 44, in response to the completion of adjustment of the second RCD 46 to the sealing configuration, and/or in response to confirmation that the second RCD 46 is in the sealing configuration. As discussed above, the first actuator assembly 70 may be configured, such as in FIG. 3, to exert a radially-outward force on the sealing element 90 to actively withdraw the sealing element 90 to facilitate passage of the joint 52 thought the sealing element 90. However, other configurations (e.g., passive-withdrawal systems) may be utilized instead.

In some embodiments, the first RCD 44 may remain in the withdrawn configuration until signals indicate that the second RCD 46 should be adjusted to the withdrawn configuration. However, in some embodiments, the controller 82 may provide control signals to the first actuator assembly 70 to adjust the first RCD 44 to the sealing configuration automatically once the joint 52 has completed its pass thru the sealing element 90 (e.g., in response to receipt of signals from the one or more sensors 80 positioned proximate to the exit of the first RCD 44; based on data that indicates that the joint 52 is thru the sealing element 90, such as an initial position of the joint 52 relative to the sealing element 90, a length of the joint 52, a length of the sealing element 90, and/or a rate of travel of the tubular in the axial direction 50).

In step 138, the controller 82 may receive signals indicative of a presence of the joint 52 of the tubular 36 proximate to the second RCD 46 (e.g., proximate to an entrance of the second RCD 46) via the one or more sensors 80. In step 140, the controller 82 may provide control signals to the first actuator assembly 70 associated with the first RCD 44 to drive the first RCD 44 to the sealing configuration in response to receipt of the signals indicative of the presence of the joint 52 of the tubular 36 proximate to the second RCD 46. As discussed above, in some cases, the first RCD 44 may already be in the sealing configuration (e.g., as a default). In some embodiments, the controller 82 may confirm that the first RCD 44 is in the sealing configuration prior to proceeding to step 242 (e.g., based on signals from the one or more sensors 122).

In step 142, the controller 82 may provide control signals to the second actuator assembly 72 associated with the second RCD 46 to drive the second RCD 46 to the withdrawn configuration in response to receipt of the signals indicative of the presence of the joint 52 of the tubular 36 proximate to the second RCD 46, in response to the completion of adjustment of the first RCD 44 to the sealing configuration, and/or in response to confirmation that the first RCD 44 is in the sealing configuration. As discussed above, the second actuator assembly 72 may be configured, such as in FIG. 3, to exert a radially-outward force on the sealing element 90 to actively withdraw the sealing element 90 to facilitate passage of the joint 52 thought the sealing element 90. However, other configurations (e.g., passive-withdrawal systems) may be utilized instead.

In some embodiments, the second RCD 46 may remain in the withdrawn configuration until signals indicate that the first RCD 44 should be adjusted to the withdrawn configuration. However, in some embodiments, the controller 82 may provide control signals to the second actuator assembly 72 to adjust the second RCD 46 to the sealing configuration automatically once the joint 52 has completed its pass thru the sealing element 90 (e.g., in response to receipt of signals from the one or more sensors 80 positioned proximate to the exit of the second RCD 46; based on data that indicates that the joint 52 is thru the sealing element 90). It should be appreciated that the method 130 may be adapted to be carried out while the tubular 36 moves into the well 16 or is pulled out of the well 16.

While the disclosure may be susceptible to various modifications and alternative forms, specific embodiments have been shown by way of example in the drawings and have been described in detail herein. However, it should be understood that the disclosure is not intended to be limited to the particular forms disclosed. Rather, the disclosure is intended to cover all modifications, equivalents, and alternatives falling within the spirit and scope of the disclosure as defined by the following appended claims.

The invention claimed is:

1. A rotating control device (RCD) system, comprising:

a first RCD comprising a first body and a first sealing element within the first body;

a second RCD comprising a second body and a second sealing element within the second body; and a controller configured to:

control a first actuator assembly to adjust the first RCD to a withdrawn configuration in which the first sealing element is not positioned to seal about a tubular, wherein the first actuator assembly is configured to exert a radially-outward force on the first sealing element to adjust the first sealing element to the withdrawn configuration; and control a second actuator assembly to maintain the second RCD in a sealing configuration in which the second sealing element is positioned to seal about the tubular while the first RCD is in the withdrawn configuration.

2. The RCD system of claim 1, comprising one or more sensors positioned proximate to respective ends of the first RCD, wherein the one or more sensors are configured to detect a presence of a joint of the tubular.

3. The RCD system of claim 2, wherein the controller is configured to:

receive signals from the one or more sensors, and the signals are indicative of the presence of the joint of the tubular proximate to an entrance of the first RCD; and control the first actuator assembly to adjust the first RCD to the withdrawn configuration in response to receipt of the signals.

4. The RCD system of claim 3, wherein the controller is configured to control the second actuator assembly to adjust the second RCD to the sealing configuration in response to receipt of the signals.

5. The RCD system of claim 4, wherein the controller is configured to control the first actuator assembly to adjust the first RCD to the withdrawn configuration in response to receipt of the signals and in response to the second RCD reaching the sealing configuration.

6. The RCD system of claim 1, comprising one or more sensors configured to detect that the second RCD is in the sealing configuration, and wherein the controller is configured to:

receive signals from the one or more sensors, wherein the signals are indicative of the second RCD being in the sealing configuration; and control the first actuator assembly to adjust the first RCD to the withdrawn configuration in response to receipt of the signals.

7. The RCD system of claim 1, wherein the first actuator assembly comprises:

a push portion that is configured to contact the first sealing element; and a support rod coupled to the push portion, wherein the support rod extends in an axial direction and is configured to engage and to exert the radially-outward force on a lip of the first sealing element to adjust the first sealing element to the withdrawn configuration.

8. The RCD system of claim 1, wherein the controller is configured to:

control the second actuator assembly to adjust the second RCD to the withdrawn configuration in which the second sealing element is not positioned to seal about the tubular; and control the first actuator assembly to maintain the first RCD in the sealing configuration in which the first sealing element is positioned to seal about the tubular while the second RCD is in the withdrawn configuration.

9. The RCD system of claim 1, further comprising one or more sensors configured to monitor a location of a joint of the tubular relative to the first RCD and the second RCD, wherein the controller is further configured to:

receive from the one or more sensors signals indicative of the location of the joint of the tubular relative to the first RCD and the second RCD;

control the first actuator assembly to adjust the first RCD to the withdrawn configuration in response to receipt of the signals; and control the second actuator assembly to maintain the second RCD in the sealing configuration in response to receipt of the signals.

10. A method of operating a rotating control device (RCD) system, the method comprising:

receiving, at one or more processors, signals indicative of a presence of a joint of a tubular proximate to an entrance of a first RCD;

adjusting, using the one or more processors, the first RCD to a withdrawn configuration in which a first sealing element of the first RCD does not seal about the tubular in response to receipt of the signals by causing an actuator assembly to exert a radially-outward force on the first sealing element; and maintaining, using the one or more processors, a second RCD in a sealing configuration in which a second sealing element of the second RCD seals about the tubular while the first RCD is in the withdrawn configuration.

11. The method of claim 10, comprising adjusting, using the one or more processors, the second RCD to the sealing configuration in response to receipt of the signals.

12. The method of claim 11, comprising adjusting, using the one or more processors, the first RCD to the withdrawn configuration after adjusting the second RCD to the sealing configuration.

13. The method of claim 10, comprising:

receiving, at the one or more processors, additional signals indicative of the second RCD being in the sealing configuration; and adjusting, using the one or more processors, the first RCD to the withdrawn configuration in response to receipt of the signals and in response to receipt of additional signals.

14. The method of claim 10, comprising:

receiving, at the one or more processors, additional signals indicative of a presence of the joint of the tubular proximate to a respective entrance of the second RCD;

adjusting, using the one or more processors, the second RCD to the withdrawn configuration in which the second sealing element does not seal about the tubular in response to receipt of the additional signals; and maintaining, using the one or more processors, the first RCD in the sealing configuration in which the first sealing element seals about the tubular while the second RCD is in the withdrawn configuration.

15. An apparatus, comprising:

a rotating control device (RCD) comprising:

a body;

a sealing element within the body, wherein the sealing element is adjustable between:

a withdrawn configuration in which the sealing element is not positioned to seal about a tubular; and a sealing configuration in which the sealing element is positioned to seal about the tubular; and an actuator assembly configured to exert a radially-outward force on the sealing element to adjust the sealing element to the withdrawn configuration, the actuator assembly is an instance of a plurality of actuator assemblies;

each of the actuator assemblies is connected to a corresponding portion of the sealing element; and each of the actuator assemblies is operable to exert the radially-outward force on the corresponding portion of the sealing element to adjust the sealing element to the withdrawn configuration.

16. The apparatus of claim 15, wherein the actuator assembly comprises:

a push portion that is configured to contact the sealing element; and a support rod coupled to the push portion, wherein the support rod extends in an axial direction and is configured to engage and to exert the radially-outward force on a lip of the sealing element to adjust the sealing element to the withdrawn configuration.

17. The apparatus of claim 15, wherein the actuator assembly comprises:

a cylinder;

a piston within the cylinder;

one or more rods connecting the piston to the sealing element; and a fluid source fluidly connected with the cylinder, wherein the fluid source is operable to supply a fluid to the cylinder to cause the actuator assembly to exert the radially-outward force on the sealing element to adjust the sealing element to the withdrawn configuration.

18. The apparatus of claim 17, wherein the piston and the one or more rods move in a radially-outward direction to thereby cause the actuator assembly to exert the radially-outward force on the sealing element when the fluid source supplies the fluid to the cylinder.

19. The apparatus of claim 15, further comprising a controller configured to:

control the actuator assembly to adjust the RCD to the withdrawn configuration; and control the actuator assembly to adjust the RCD to the sealing configuration.

* * * * *